US006467573B1

(12) United States Patent
Parker

(10) Patent No.: US 6,467,573 B1
(45) Date of Patent: Oct. 22, 2002

(54) FALL PROTECTION ASSEMBLY

(75) Inventor: Michael J. Parker, Kemah, TX (US)

(73) Assignee: Parker Systems, Inc., Houston, TX (US)

( * ) Notice: Subject to any disclaimer, the term of this patent is extended or adjusted under 35 U.S.C. 154(b) by 0 days.

(21) Appl. No.: 09/734,476

(22) Filed: Dec. 11, 2000

(51) Int. Cl.[7] ..... A62B 35/00
(52) U.S. Cl. ..... 182/3
(58) Field of Search ..... 182/3, 4, 6, 7

(56) References Cited

U.S. PATENT DOCUMENTS

| | | | | | |
|---|---|---|---|---|---|
| 3,343,862 | A | | 9/1967 | Holmes | |
| 3,352,590 | A | | 11/1967 | Barthule | |
| 4,991,689 | A | * | 2/1991 | Cole | 182/3 |
| 5,123,690 | A | | 6/1992 | Bailey | |
| 5,683,131 | A | | 11/1997 | Lucas | |
| 5,738,046 | A | * | 4/1998 | Williams | 182/3 |
| 5,927,431 | A | | 7/1999 | Klein, Jr. | |

FOREIGN PATENT DOCUMENTS

| | | | | |
|---|---|---|---|---|
| FR | 2501048 | * | 9/1982 | 182/3 |
| JP | 403275078 | * | 12/1991 | 182/3 |

OTHER PUBLICATIONS

Web Devices' brochure "Harnessing the Future".

* cited by examiner

*Primary Examiner*—Alvin Chin-Shue
(74) *Attorney, Agent, or Firm*—Browning Bushman, P.C.

(57) ABSTRACT

A lanyard (12) connected to a body harness (10) for supporting a person from fixed horizontal support member (38) upon an inadvertent fall of the person from a normal supporting surface. A hook (16) on the upper end of the lanyard (12) is looped over the fixed horizontal support member (38) and received within a V-shaped eye opening (54) of an eye member (50). The V-shaped eye opening (54) is defined by a pair of straight converging sides (58,60) which intersect at an arcuate apex (62) having a relatively small width to receive the hook (16) in a snug fit.

8 Claims, 2 Drawing Sheets

FALL PROTECTION ASSEMBLY

FIELD OF THE INVENTION

This invention relates to a fall protection assembly and more particularly to a safety lanyard connected between a body harness and a fixed horizontal support member for stopping the inadvertent fall of a person from a normal supporting surface.

BACKGROUND OF THE INVENTION

Heretofore, fall protection assemblies have been provided including a lanyard having an end hook for connection to a D-ring on the lanyard. A hook which is received within a D-ring permits relative sliding movement between the hook and D-ring which may provide a side loading on the hook from the D-ring. The hook normally includes a releasable latch which permits connection of the D-ring to the hook in a snap fit. If the D-ring rides along the hook to the latch on the hook and exerts a side loading against the hook, it is possible that the D-ring could be inadvertently released by the latch. It is desirable that any side loading of the hook from a connecting ring be eliminated.

SUMMARY OF THE INVENTION

The present invention is particularly directed to a lanyard formed of a flat web strap for supporting a workman from a separate support upon an inadvertent fall of the workman from a normal supporting surface. The lanyard is connected to a body harness about the workman and extends from the harness to a separate horizontal safety support member for support of the workman therefrom upon an inadvertent fall of the workman. The lanyard which normally comprises a flat web strap has a slider member on the strap having a pair of parallel rectangular openings receiving the strap. The slider member is positioned at a predetermined location on the lanyard for positioning the eye-member for connection to a hook on the extending end of the lanyard. The eye member has a V-shaped eye opening to receive the hook. The V-shaped eye opening is formed by a pair of straight converging sides which intersect in an arcuate apex having a relatively small width to provide a snug fit between the hook and the V-shaped eye member and to eliminate any side loading. The slider member has a generally rectangular shape and a center bar or divider defines the pair of generally rectangular parallel openings. The lanyard is passed through the rectangular openings over the center bar to permit selected adjustment of the slider member and eye member along the length of the flat strap. The eye member for connection to the hook has a divider pin or bar and a pair of opposed openings on opposed sides of the divider. One of the openings in the eye-member is the V-shaped eye opening and the other opening is of a generally rectangular shape to receive the lanyard therein after it passes through one of the rectangular openings in the slider. When the lanyard is in an assembled position, the slider member and the eye member are in contact relation to each other and are held together by the web strap. The hook is received in the V-shaped eye opening in the eye member and exerts an axial pull on the hook thereby to minimize any side loading and prevent inadvertent removal of the eye member from the hook.

It is an object of the invention to provide a fall protection assembly to stop the fall of a workman including a lanyard between a body harness and a fixed horizontal support member.

A further object of the invention is to provide such a lanyard looped over the fixed horizontal support member and having an end hook received within a V-shaped eye opening to eliminate any side loading exerted against the hook from the eye member.

A further object of the invention is the provision of such a lanyard in which a slider member is mounted on the lanyard and used in combination with the V-shaped eye member with the slider member permitting adjustment of the eye member along the length of the lanyard with divider bars on the slider member and eye member defining adjacent rectangular openings receiving the lanyard.

Other objects, features and advantages of the invention will be apparent from the following specification and drawings.

BRIEF DESCRIPTION OF THE INVENTION

Figure 1:
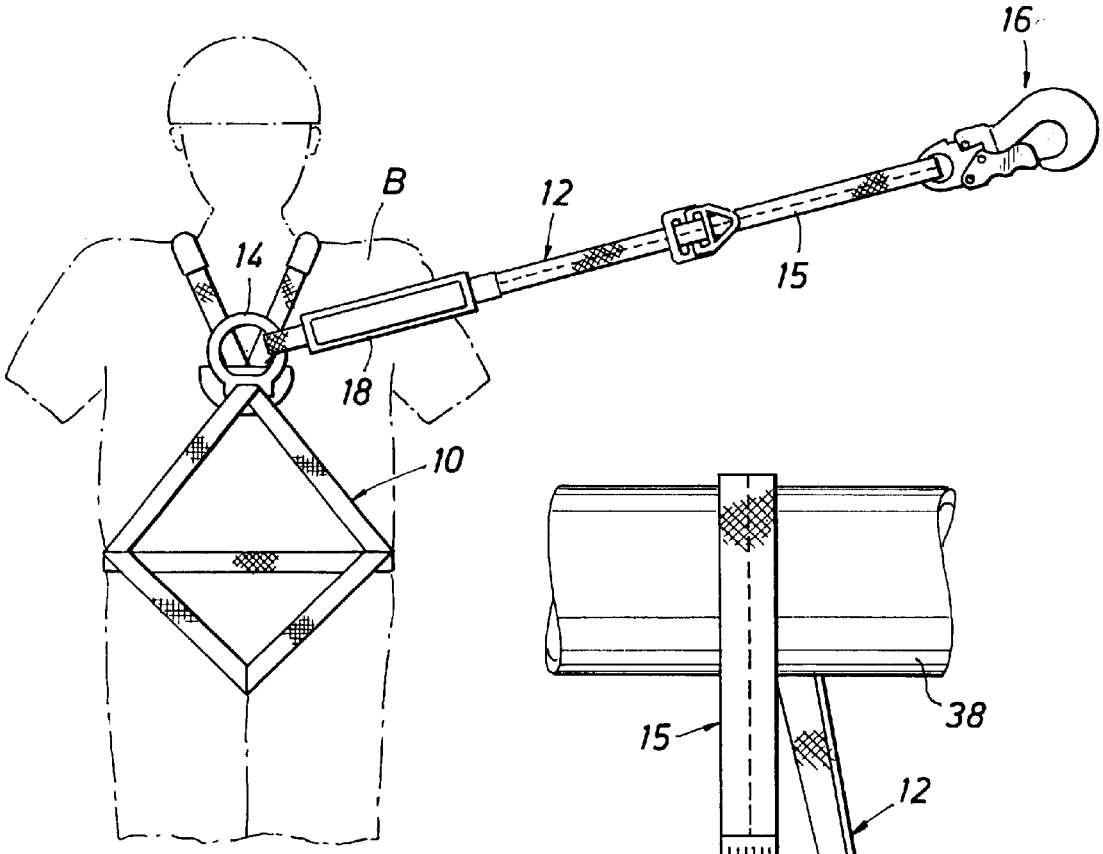
FIG. 1 is an elevational view of the safety lanyard comprising the present invention secured to a body harness on a workman.

Referring now to the drawings for a better understanding of the invention, a body harness is shown generally at 10 in FIG. 1 having shoulder and leg straps for fitting about the body B of a workman. A safety lanyard comprising the present invention is shown generally at 12 connected to a suitable D-ring 14 on harness 10. Lanyard 12 is formed of a flat web material or webbing 15 about six feet in length. A snap hook generally indicated in 16 is mounted on one end of lanyard 12 and a shock absorber 18 is mounted on the opposite end of lanyard 12 adjacent D-ring 14. Shock absorber 18 may include a plurality of folded elastomeric sections or loops for arresting the fall of a workman at about 700 pounds of force. Upon a force exerted against lanyard 15 from the weight of a workman, shock absorber 18 is actuated with the elastomeric sections unfolding and stretched to a taut position as well known thereby to stop the fall of the workman. Shock absorber 18 in a taut position may be about three feet in length. Snap hook 16 has a body 20 with a web engaging portion 22 at one end and a hook-shaped portion 23 at an opposite end. The hook engaging portion 23 has a generally semicircular shape with an extending tip 24. A keeper or latch 26 is spring urged about pivot 28 to a closed position against tip 24. A safety release 30 is pivoted about pivot 32 and must be pressed manually inwardly before latch 26 can be moved to an open position. Flat webbing 15 passes through an eye 33 in web engaging portion 22 and has an end stitched to a lapping layer of webbing 15.

Figure 5:
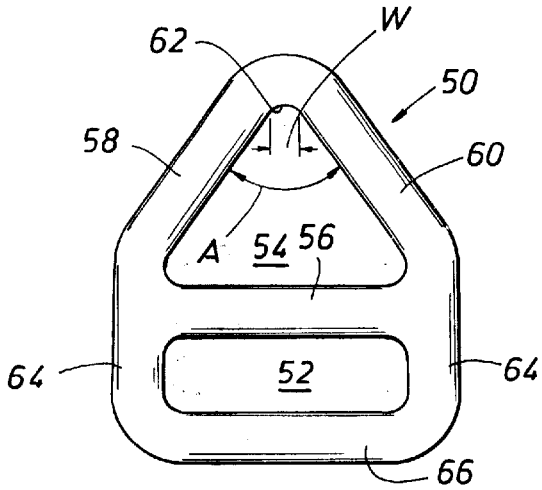
FIG. 5 is a plan view of the eye member having a generally triangular eye for receiving a hook with the apex of the eye formed by straight converging sides.

Mounted adjacent snap hook 16 for anchoring snap hook 16 about a fixed horizontal support such as fixed support rod 38 is an eye and slider combination which includes slider 42 and an eye member 50. Slider 42 is generally rectangular in shape and has a pair of similar rectangular openings 44 separated by a center bar or divider 46 and arranged to receive flat webbing 15 through openings 44 over divider 46. Eye member 50 as shown particularly in FIG. 5 has a rectangular opening 52 and a V-shaped eye opening 54 separated by a center bar or divider 56 from rectangular opening 52. Angle A is defined by straight converging sides 58 and 60 which intersect to form a arcuate apex 62 having a relatively small width W less than about ½ inch. Angle A is preferably about 75 degrees but satisfactory results may be obtained with angle A being between about 60 degrees and 85 degrees. Eye member 50 has a pair of parallel sides 64 extending from converging sides 58 and 60. A lower connecting side 66 parallel to center bar 56 connects parallel sides 64. Thus, any hook positioned within eye 54 will slide along converging straight sides 58 and 60 to apex 62 in a snug fit upon a force exerted against lanyard 12. The small width W of apex 62 limits any sideways movement or loading of hook 16 when an axial force is exerted against lanyard 12.

For installation of lanyard 12, hook 16 of lanyard 12 is positioned over a fixed horizontal support rod 38. Safety release 30 is manually pivoted to release latch 26 so that hook 16 may be received within eye opening 54 of eye member 50 in a snap fit. Latch 26 is spring urged into contact with tip 24 of hook 16. Slider 42 is positioned at a predetermined location along lanyard 12 by feeding of the flat webbing 15 through openings 44 and over divider 46. Eye member 50 is positioned on lanyard 12 by feeding of the flat webbing 15 through rectangular opening 52 simultaneous with the feeding of webbing 15 through openings 44. Opening 52 is positioned between openings 44 and bottom side 66 is normally in contact with divider 46 of slider 42. Next, the lower end of lanyard 12 is connected by a suitable loop or hook to D-ring 14 on harness 10. As indicated, lanyard 12 is about six feet in length. In some instances, such as shown in FIG. 1, it may be desirable to first hook lanyard 12 to harness 10 prior to anchoring of lanyard 12 over fixed horizontal support 38.

Figure 2:
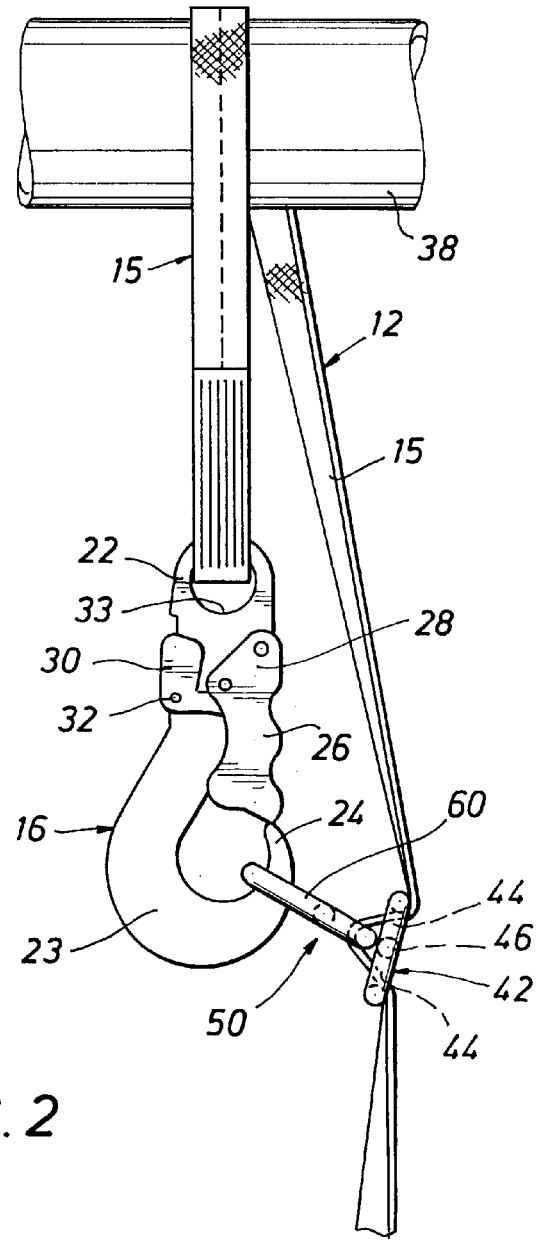
FIG. 2 is an enlarged elevational view of the upper end portion of the lanyard shown in FIG. 1 and showing the lanyard mounted about a fixed horizontal bar for anchoring the lanyard with the hook shown as initially connected to the eye member.
Figure 3:
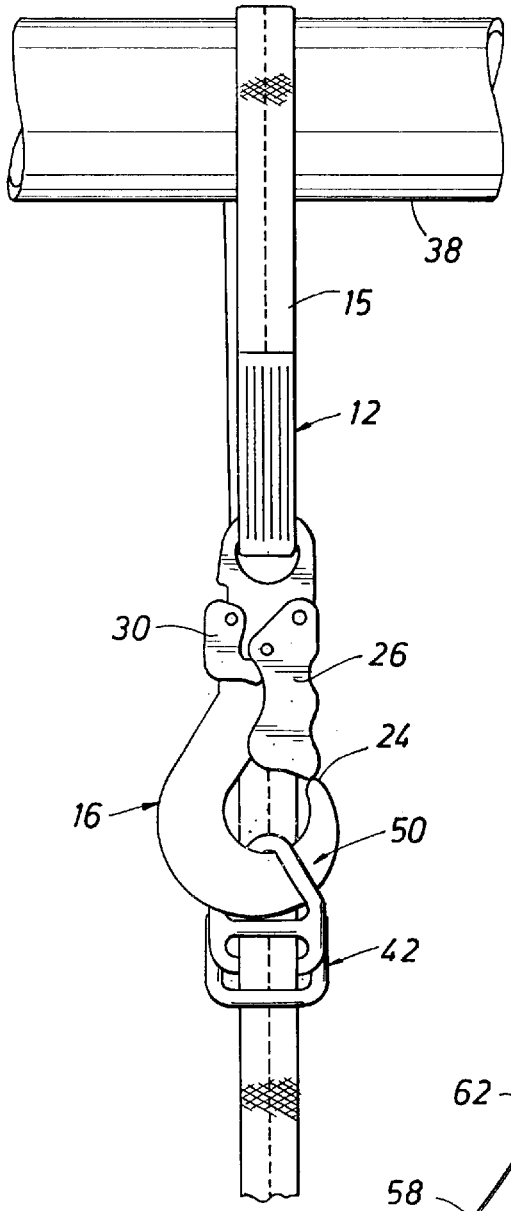
FIG. 3 is an enlarged elevational view similar to FIG. 2 but showing the safety lanyard in a taut position with the lanyard exerting an axial pull on the hook such as may result from the fall of a workman.
Figure 4:
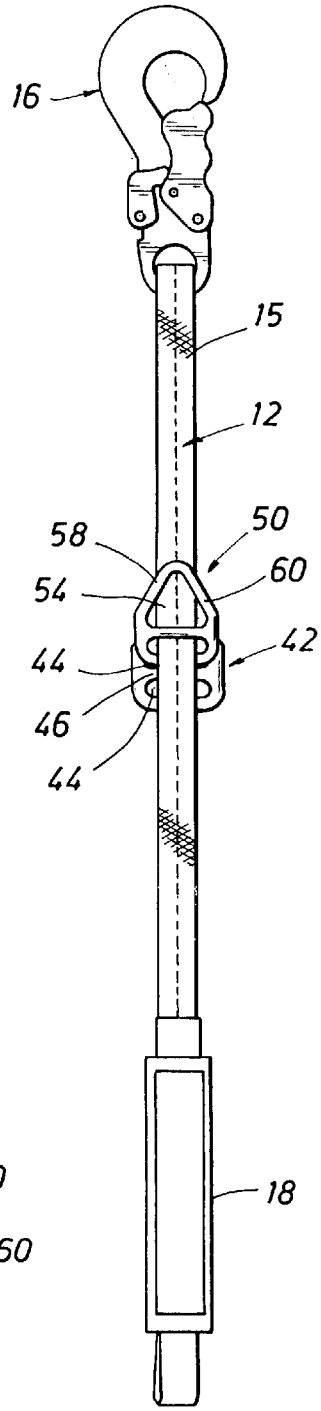
FIG. 4 is a plan view of the safety lanyard showing the lanyard removed from the body harness shown in FIG. 1.

FIG. 2 illustrates lanyard 12 after being mounted over fixed horizontal support 38 and prior to any force exerted against lanyard 12 from the fall of a workman. FIG. 3 shows lanyard 12 in a taut position which may occur from an inadvertent fall of a workman. Hook 16 upon a force exerted by lanyard 12 slides along straight sides 58 and 60 to apex 62 where it fits snugly. The width W of the arcuate apex 62 is preferably less than about ½ inch.

From the foregoing, it is apparent that an improved lanyard has been provided for connection to a body harness for supporting a person from a fixed horizontal support member upon an inadvertent fall of the person from a normal supporting surface. The lanyard is looped over the fixed horizontal support member and a hook on the upper end of the lanyard is mounted in an eye member having a V-shaped opening for receiving the hook therein. The V-shaped opening of the eye member is defined by a pair of straight converging sides forming an apex of an arcuate shape. The arcuate apex has a small width so that the hook is received in a snug fit with the sides converging at an angle A between about 60 degrees and 85 degrees.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A fall protection structure to support a person upon an inadvertent fall of the person from a normal supporting surface; said fall protection structure comprising:

a body harness for fitting about the body of the person and having a D-ring thereon;

a fixed horizontal support member adjacent the normal supporting surface;

a lanyard having a single flat web strap and extending between the D-ring on said body harness and said fixed horizontal support member;

said lanyard including:

a slider member on said flat web strap having a generally rectangular shape with a divider defining a pair of adjacent generally rectangular parallel openings, the flat web strap extending through said parallel openings over said divider to permit selected adjustment of the slider member along the length of the flat web strap to a desired location;

an eye member having a divider defining a pair of openings on opposite sides of said divider, one of said openings being of a V-shape and the other opening being of a generally rectangular shape; said flat web strap extending through the rectangular opening of said eye member between said rectangular parallel openings of said slider member, said divider of said slider member being in contact relation to said eye member when said web strap passes through said rectangular openings of said slider member; and a hook received within said V-shaped opening of said eye member with said eye member exerting an axial pull on said hook upon the exertion of force on said lanyard thereby to eliminate any side loadings on said hook;

said hook mounted on an upper end of said strap with said strap looped over said fixed horizontal support member for anchoring said lanyard on said fixed support member.

2. A fall protection structure as defined in claim 1, wherein said V-shaped opening of said eye member is defined by a pair of straight converging sides forming an apex of an arcuate shape.

3. A fall protection structure as defined in claim 1, wherein said apex has a width of less than about ½ inch and said converging sides converge at an angle between about 60 degrees and 85 degrees.

4. A fall protection device as defined in claim 3, further comprising:

a shock absorber positioned on said lanyard adjacent said body harness on said person.

5. A lanyard connected to a D-ring on a body harness for supporting a person upon an inadvertent fall of the person from a normal supporting surface; said lanyard comprising:

a single flat web strap extending from the D-ring on said harness to a fixed safety support for support of the person therefrom upon an inadvertent fall of the person;

a slider member on said flat web strap having a generally rectangular shape with a divider defining a pair of adjacent generally rectangular parallel openings, the flat web strap extending through said parallel openings over said divider to permit selected adjustment of the slider member along the length of the flat web strap at a desired location;

an eye member having a divider defining a pair of openings on opposite sides of said divider, one of said openings being of a V-shape and the other opening being of a generally rectangular shape; said flat web strap extending through the rectangular opening of said eye member between said rectangular parallel openings of said slider member, said divider of said slider member being in contact relation with said eye member when said web strap is passed through said rectangular openings of said slider member;

a hook received within said V-shaped opening of said eye member with said eye member exerting an axial pull on said hook upon the exertion of force on said lanyard thereby to eliminate any side loadings on said hook; and said V-shaped opening of said eye member defining a pair of straight converging sides forming an apex of an arcuate shape snugly receiving said hook, said fixed safety support comprising a fixed horizontal support member and said lanyard having a supporting loop about said fixed support member.

6. A lanyard as defined in claim 5, wherein said apex has a width of less than about ½ inch and said converging sides converge at an angle between about 60 degrees and 85 degrees.

7. A lanyard as defined in claim 5, wherein said hook has a releasable latch thereon to permit said eye member to be releasably latched thereto.

8. A lanyard as defined in claim 5, wherein a shock absorber is positioned on said lanyard adjacent said body harness.

* * * * *